US008312641B2

(12) United States Patent
Li et al.

(10) Patent No.: US 8,312,641 B2
(45) Date of Patent: Nov. 20, 2012

(54) UV LED CURING APPARTUS WITH IMPROVED ILLUMINATION AND TIMER CONTROL

(75) Inventors: Yu-Jen Li, Taipei Hsieng (TW); Kuo-Chang Chang, Taipei Hsieng (TW); Fu-Ju Sheu, Taipei Hsieng (TW); Szu-Hua Wu, Taipei Hsieng (TW)

(73) Assignee: Cosmex Co., Ltd., Taipei Hsieng (TW)

( * ) Notice: Subject to any disclaimer, the term of this patent is extended or adjusted under 35 U.S.C. 154(b) by 475 days.

(21) Appl. No.: 12/762,227

(22) Filed: Apr. 16, 2010

(65) Prior Publication Data

US 2011/0252661 A1 Oct. 20, 2011

(51) Int. Cl.
*F26B 3/34* (2006.01)

(52) U.S. Cl. ..... 34/277; 34/278; 34/201; 250/504 R; 118/642

(58) Field of Classification Search ..... 34/275, 34/277, 278, 105, 201; 250/504 R, 455.11, 250/492.1; 118/504, 642, 620
See application file for complete search history.

(56) References Cited

U.S. PATENT DOCUMENTS

| | | | | |
|---|---|---|---|---|
| 4,309,617 | A * | 1/1982 | Long | 250/504 H |
| 4,731,541 | A | 3/1988 | Shoemaker | |
| 5,130,551 | A | 7/1992 | Nafziger et al. | |
| 5,298,837 | A * | 3/1994 | Diestl | 315/289 |
| 5,459,944 | A * | 10/1995 | Tatsutani et al. | 34/202 |
| 5,515,621 | A * | 5/1996 | Bloom | 34/275 |
| 6,518,583 | B1 | 2/2003 | Hennig | |
| 6,762,425 | B1 | 7/2004 | Strait | |
| 6,783,705 | B1 * | 8/2004 | Leveille | 252/588 |
| 7,707,741 | B2 * | 5/2010 | Singh | 34/443 |
| 2004/0250443 | A1 * | 12/2004 | Delaney et al. | 34/275 |
| 2008/0168677 | A1 * | 7/2008 | Miller | 34/202 |
| 2008/0256825 | A1 * | 10/2008 | Hsu | 34/529 |
| 2008/0282576 | A1 * | 11/2008 | Ueda et al. | 34/562 |
| 2011/0252661 | A1 * | 10/2011 | Li et al. | 34/275 |
| 2011/0277338 | A1 * | 11/2011 | Li et al. | 34/275 |
| 2012/0060757 | A1 * | 3/2012 | Li et al. | 118/620 |

FOREIGN PATENT DOCUMENTS

| | | | |
|---|---|---|---|
| GB | 2420078 A | * | 5/2006 |
| GB | 2428382 A | * | 1/2007 |

(Continued)

*Primary Examiner* — Stephen M. Gravini
(74) *Attorney, Agent, or Firm* — WPAT, P.C.; Anthony King

(57) ABSTRACT

The present invention is related to an UV LED curing apparatus, and more particularly, to a portable UV LED curing apparatus with improved illumination and timer control to solidify a UV hardening gel, such as acrylic gel. The present invention provides an UV LED curing apparatus comprising a housing and an UV LED lighting assembly enclosed in the housing. The housing is provided with a light aperture allowing UV light shone from an UV LED light source on the UV LED lighting assembly and controlled by a timer and a current regulator integrated thereon. The UV LED lighting assembly is further provided with an optical element to direct and confine UV light shine toward the light aperture of the housing, capable of providing a focused illumination and preventing leakage of UV light outside of the housing. The UV LED light source is preferably of a short wavelength such as between 360 nm and 410 nm, and the current supplied from a power supply to the UV LED light source on the substrate is preferably controlled automatically by the timer and the current regulator integrated thereon to shine UV light toward the light aperture of the housing for a prescribed period of time preferably less than 30 seconds triggered by a switch electrically connected thereto.

20 Claims, 5 Drawing Sheets

FOREIGN PATENT DOCUMENTS

| | | | | |
|---|---|---|---|---|
| GB | 2446922 | A | * | 8/2008 |
| JP | 05220208 | A | * | 8/1993 |
| JP | 2011238748 | A | * | 11/2011 |
| JP | 2012005984 | A | * | 1/2012 |

* cited by examiner

UV LED CURING APPARTUS WITH IMPROVED ILLUMINATION AND TIMER CONTROL

FIELD OF THE INVENTION

The present invention relates to an ultraviolet (UV) curing apparatus, and more particularly, to an UV light emitting diode (LED) curing apparatus utilizing an UV LED light source for solidifying an acrylic gel applied onto the nails of human fingers and toes as well as those of animal pets.

BACKGROUND OF THE INVENTION

As solid state lighting or LED lighting is being widely adapted in various applications of lighting and is becoming one of the great solutions to a greener world. Among various types of LED, a new family of LED capable of emitting UV radiation or light in a shorter wavelength than the visible light, also known as UV LED, has been developed for industrial applications.

Despite the fact that UV rays can be harmful to the health of human in general since UV is more energetic than visible light and is therefore more dangerous, UV has its unique application in the industry. Certain industrial applications utilize UV rays for curing a specific liquid and such usage of UV has shown merits in printing techniques and creating of protective layers on industrial products. Conventional UV lamps have also been used to curing an acrylic liquid or gel in cosmetic applications to facilitate the creation of nail arts and nail protections.

Known UV devices for curing a specific UV hardening gel generally utilize traditional UV lamps and bulbs. U.S. Pat. No. 4,731,541 "Ultraviolet Light for use in Setting Gels for Artificial Fingernails" to Shoemaker discloses a UV device using traditional UV lamps for creating a protective layer on human hand nails by exposing the UV hardening gel coated on the nails under the lamp while allowing human hands to rest within the housing. U.S. Pat. No. 5,130,551 "Nail Drying Apparatus" to Nafzigar et al. adopts similar concepts of UV hardening gel and traditional UV lamps but with an improved design capable of receiving both the human hand and toe nails. U.S. Pat. No. 6,518,583 "Optical Exposure in particular a Table Lamp for Hardening Light-Hardening Gel in the courses of Fingernail Treatment" to Henning discloses a UV device for human hands that also utilizes traditional UV lamps but by using more UV bulbs, the UV lighting area is therefore increased to cover multiple fingernails at once. U.S. Pat. No. 6,762,425 "Portable Device for Curing Gel Nail Preparations" to Strait discloses a UV device for curing gel applied to the nails of both human hands and feet and as the UV compartment and lamps are designed specifically to treat both hands and feet received therein, Strait is able to harden the UV hardening gel applied to not just the nails of fingers but also toes at once.

One major concern to the use of such UV devices with human hands or feet is the hazard of having human skin exposed to UV rays under these traditional UV lamps or bulbs of the devices for a short or long period of time that may lead to undesirable skin cancer in a long run. Such hazard is also known to be closely related to the fact that traditional UV lamps typically emit three types of UV light in reference to skin protection and these are UVA, UVB, and UVC. Among the three rays, UVC is the most damaging and is the most energetic of the three types.

In view of the foregoing, it is desirable to provide a UV curing device capable of overcoming the drawbacks of the known arts while providing a green solution to the environment with a greater safety to humans. Furthermore, it is also desirable to provide an UV curing device to facilitate the creation of nail arts and nail protections.

SUMMARY OF THE INVENTION

In order to overcome the shortcomings described above, one aspect of the present invention is to provide an UV LED curing apparatus capable of curing an UV LED hardening gel such as an acrylic gel by solidifying the gel from liquid to solid state effectively and efficiently.

Another aspect of the present invention is to provide an UV LED curing apparatus with improved UV illumination to provide focused lighting for more effective curing effects and to confine UV rays for preventing the escape of such UV light to undesired areas.

Still another aspect of the present invention is to provide an UV LED curing apparatus with enhanced timer control to control the exposure time of the UV lighting more accurately and to adapt to the characteristics of UV hardening gel such as acrylic gel more effectively.

A further aspect of the present invention is to provide an UV LED curing apparatus that may be a standalone lamp or a handheld device of low maintenance, high reliability and requiring less replacement parts.

In one embodiment of the present invention, the UV LED curing apparatus mainly comprises a housing and a UV LED lighting assembly enclosed in the housing. The housing comprises a top shell attached to a bottom cover and a light aperture; and the UV LED lighting assembly further comprises a substrate, an UV LED light source, an optical element, a power supply, and a switch. The substrate may be secured within the housing and comprise a timer means and a current regulator, integrated on either a first surface or a second surface of the substrate. The UV LED light source on the substrate may include a light emitting side arranged to be facing toward the light aperture of the housing. The optical element may be further provided adjacent to the UV LED light source on the substrate and may further include a collimator to direct light from the UV LED light source toward the light aperture of the housing. The power supply further comprises an input terminal electrically connected to the UV LED light source via the current regulator on the substrate. In addition, a switch may be provided to be electrically connected to the timer means and the current regulator to control an on-off state of the UV LED light source on the substrate. During the operation of the UV LED apparatus, the current regulator regulates current from the input terminal of the power supply to the UV LED light source with reference to a predefined interval of time signaled from the timer means and triggered by the switch to control the on-off state of the UV LED light source.

As the UV LED of the present invention may be of a selected range and may be controlled by the timer automatically, the UV LED of spectrum between 360 nm and 410 nm may preserve the safe use of UVA and UVB rays, UVA in particular, on human fingers and toes while the UV exposure time may be optimally set for less than or equal to 30 seconds providing a safe, effective and efficient curing of UV hardening gel such as acrylic gel on fingernails of hands and/or toes.

In one embodiment of the present invention, the UV LED light source and the power supply attached to the substrate of the UV LED curing apparatus may be arranged on opposing sides of the substrate such that the possible damages caused by the effect of the heat generated by the two components may be reduced on each other. In addition, such dual side design of the substrate and arrangement of the UV LED light source and power supply may facilitate the manufacturing process and reduce the assembly costs while providing a greater reliability to the present invention as a whole.

In another embodiment of the present invention, a handheld UV LED curing apparatus may be provided in addition to a desktop or standalone lamp. The handheld UV LED curing apparatus may too comprise a housing and an UV LED lighting assembly enclosed therein. The housing may further comprise a top shell including a handle portion formed thereon, a bottom cover attached to the top shell and a light aperture formed on the bottom cover. The UV LED lighting assembly, likewise, may further comprise a substrate, an UV LED light source, an optical element, a power supply and a switch. The substrate may include a timer means and a current regulator, both integrated on either a first surface or a second surface of the substrate. The UV LED light source may be of a desired short wavelength and may include a light emitting side facing toward the light aperture of the housing. The optical element secured onto the substrate and adjacent to the UV LED light source may be aligned with the light aperture of the housing and may further comprise both a collimator and a reflector. The power supply further includes an input terminal electrically connected to the UV LED light source via the current regulator and may preferably include a rechargeable battery. Similarly, the switch may be electrically connected to the timer means and the current regulator to control an on-off state of the UV LED light source. During the operation of the apparatus of the present invention, the current regulator regulates current from the input terminal of the power supply to the UV LED light source with reference to a predefined interval of time signaled from the timer means and triggered by the switch to control the on-off state of the UV LED light source. In addition, the optical element confines UV light emitted from the UV LED light source and directs said UV light toward the light aperture of the housing such that leakage of UV rays outside of curing areas relative to the light aperture thereof may be reduced.

In one embodiment, the collimator of the optical element of the UV LED curing apparatus may be a plano-convex lens having a convex light output surface for enhancing the focus of UV light. In addition, and the reflective surface of the reflector of the optical element may be formed of any one of the following metal alloys: silver, nickel, cobalt, aluminum and combinations thereof.

For greater portability of the apparatus of the present invention, in one embodiment, the UV LED curing apparatus may further comprise a rechargeable battery electrically connected to the input terminal and the current regulator; wherein the input terminal may further include a universal serial bus (USB) connector. In addition, the substrate may further comprise a pulse-width modulation/PWM electrically connected to the power supply and the current regulator to enhance the control of the on-off state of the UV LED light source.

The foregoing summary recites preferred embodiments of the present invention and is for illustrative purposes. Embodiments of the present invention may be implemented in various different ways and shall too be considered as part of the present invention within its scope. Details of the exemplary embodiments of the present invention will be further described in the following.

BRIEF DESCRIPTION OF THE DRAWINGS

The present invention may be embodied in various forms and the details of the preferred embodiments of the present invention will be described in the subsequent content with reference to the accompanying drawings. The drawings (not to scale) show and depict only the preferred embodiments of the invention and shall not be considered as limitations to the scope of the present invention. Modifications of the shape of the present invention shall too be considered to be within the spirit of the present invention.

DESCRIPTION OF EMBODIMENTS OF THE INVENTION

Figure 1:
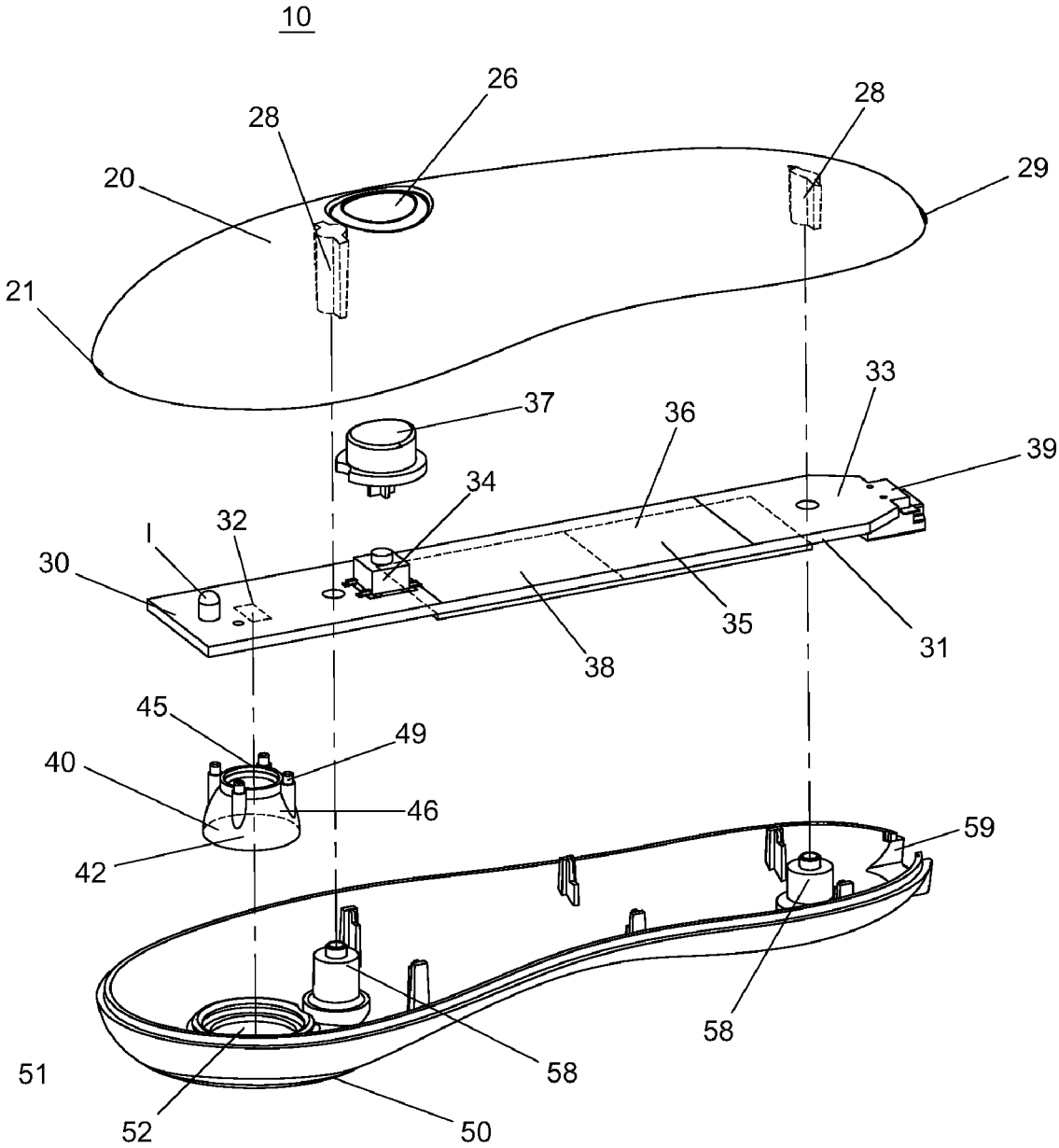
FIG. 1 is an exploded view of an UV LED curing apparatus according to one embodiment of the present invention.
Figure 2:
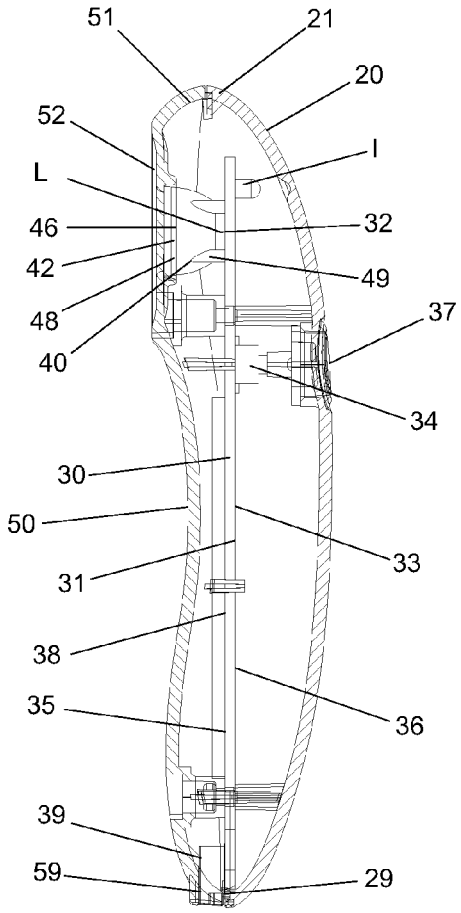
FIG. 2 is an elevated side view of the UV LED curing apparatus of the present invention in FIG. 1.
Figure 3:
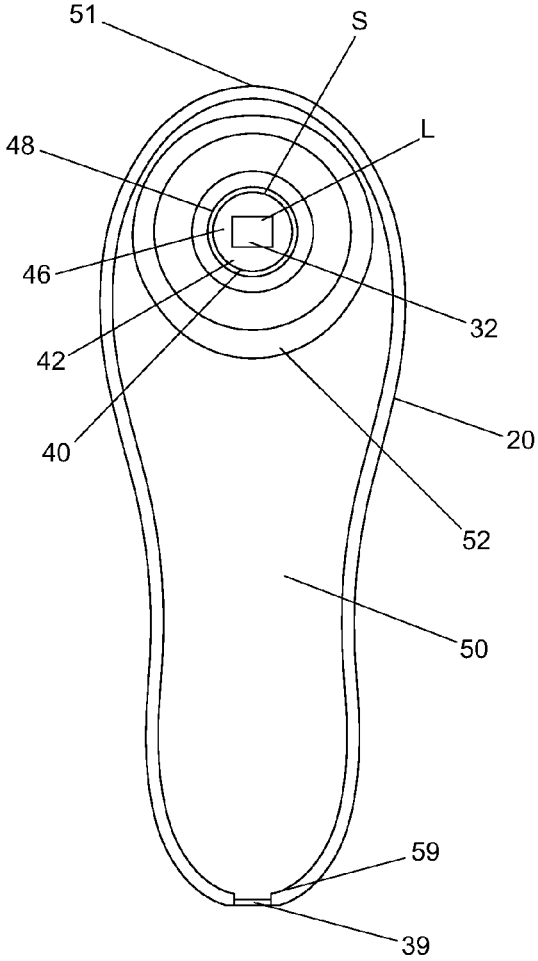
FIG. 3 is a bottom view of the UV LED curing apparatus of the present invention in FIG. 1.

FIGS. 1, 2 and 3 show an explanatory embodiment of an UV LED curing apparatus 10 of the present invention, the UV LED curing apparatus 10 comprises a housing enclosing an UV LED lighting assembly therein to shine UV LED rays of a specific wavelength for curing an UV hardening gel from a liquid-like state to a solid state. The UV LED curing apparatus 10 and the UV hardening gel may be applied to the nails of human fingers or toes and/or those of pet animals.

As shown in FIG. 1, the housing of the UV LED curing apparatus 10 of the present invention comprises a top shell 20 attached to a bottom cover 50 and furthermore, a light aperture 52 may be formed on one end 51 of the bottom cover 50 adjacent to the front end 21 of the top shell 20. It can be understood that the housing including the top shell 20 and the bottom cover 50 may be formed of any form other than elongated shapes.

The UV LED curing apparatus 10 of the present invention also comprises an UV LED lighting assembly as shown in FIG. 1. The UV LED lighting assembly comprises a substrate 30, an UV LED light source 32, a switch 34, a power supply 36 and an optical element 40. The substrate 30 may be secured within the housing and enclosed by the top shell 20 and the bottom cover 50 of the housing. As shown in FIGS. 1 and 2, the substrate 30 of the UV LED lighting assembly of the UV LED curing apparatus 10 may be secured or affixed to the top shell 20 and bottom cover 50 of housing via upper fixation means 28 and lower fixation means 58 thereof as the fixation means 28, 58 preferably engage with corresponding perforations P formed on the substrate 30; wherein the fixation means 28, 58 may be, for example, bolts, screws and adhesives. According to a preferred embodiment, the substrate 30 of the UV LED light assembly of the UV LED curing apparatus 10 of the present invention may be a metal-core printed circuit board (MCPCB). To enhance the control of lighting of the UV LED light assembly of the UV LED curing apparatus 10, a timer means 35 and a current regulator 38 may be integrated on the substrate 30 and electrically connected to the switch 34 and the power supply 38. Furthermore, in one embodiment, both the timer means 35 and the current regulator 38 may be disposed on a first surface 31 of the substrate 30; in another embodiment they may be disposed on a second surface 33 of the substrate 30. Details of the timer control circuit and mechanism will be discussed in the later content.

According to one embodiment of the present invention, the UV LED lighting assembly of the UV LED curing apparatus 10 comprises an UV LED light source 32 attached to the first surface 31 of the substrate 30 and having a light emitting side L facing toward the light aperture 52, preferably formed on the bottom cover 50, of the housing as shown in FIGS. 2 and 3. In one embodiment, the light emitting side L of the UV LED light source 32 may be preferably arranged to be substantially perpendicular to the first surface 31 of the substrate 30 such that the UV light may be emitted toward light aperture 52 and direct down lights may be provided. In another preferred embodiment, the top shell 20 and the bottom cover 50 of the housing may comprise a light aperture 52 near the front ends 21, 51 of the top shell 20 and the bottom cover 50 respectively and the UV light source 32 may be attached to the substrate 30 with a light emitting side L substantially parallel to the first or second surface 31, 33 of the substrate to emit UV light to the front of the housing. It can be understood that other directions of the UV light or rays emitting from the UV LED light source of the present invention are also possible depending upon the location of the light aperture of the present invention.

In a preferred embodiment, the UV LED light source 32 may comprise at least one UV LED or LED emitter having a short wavelength between 255 nm and 465 nm; in particular, the short wavelength may be selected to be between 360 nm and 410 nm In a more specific embodiment, the UV LED light source 32 may be of a short wavelength of 405 nm The UV LED or LED emitter may be a lamp-type LED, SMD-type LED or can-type LED; preferred examples of UV LEDs include Nichia UV LED model NSPU510CS, NCSU033A, NSHU591B. It can be understood that other UV LEDs capable of curing an UV hardening gel such as acrylic gel may be used. An UV hardening gel may transform from a liquid-like state to a solid state while being exposed to UV rays; in particular, UV LED hardening gel may undergo such phase change of solidification within 30 seconds of time subject to the UV LED light.

An optical element 40 may be provided and preferably attached to the first surface 31 of the substrate 30 of the UV LED lighting assembly of the UV LED curing apparatus 10 of the present invention. An end 45 of the optical element 40 may be further provided with fixation means 49 for securement onto the substrate as shown in FIGS. 1 and 2. It too can be understood that the securement or attachment of the optical element 40 onto the substrate 30 may also be achieved by means of for example, adhesives, fasteners such as bolts and screws. The optical element 40 may be preferably circumferencing the UV LED light source 32 to direct UV light emitted therefrom and to prevent possible leakage of UV rays escaping to the interior of the housing. As shown in FIG. 3, the optical element 40 may comprise a collimator 46 positioned adjacent or in close proximity to the UV LED light source 32 and having a light output surface 42 to direct light emitted therefrom toward an external of the housing, in particular out of the light aperture 52 of the housing. In a preferred embodiment, the collimator 46 of the optical element 40 may be a plano-convex lens having a convex light output surface to direct UV light entered. Furthermore, in another preferred embodiment, the optical element 40 may also comprise a reflector 48 aligned to the collimator 46 and having a reflective surface S (FIG. 3) circumferencing the UV LED light source 32 to reflect and confine light emitted therefrom toward an external of the light aperture 52 of the housing. The reflective surface S of the reflector 48 of the optical element 40 may be formed of any one of the following metal alloys: silver, nickel, cobalt, aluminum and combinations thereof to reflect UV light.

Figure 4:
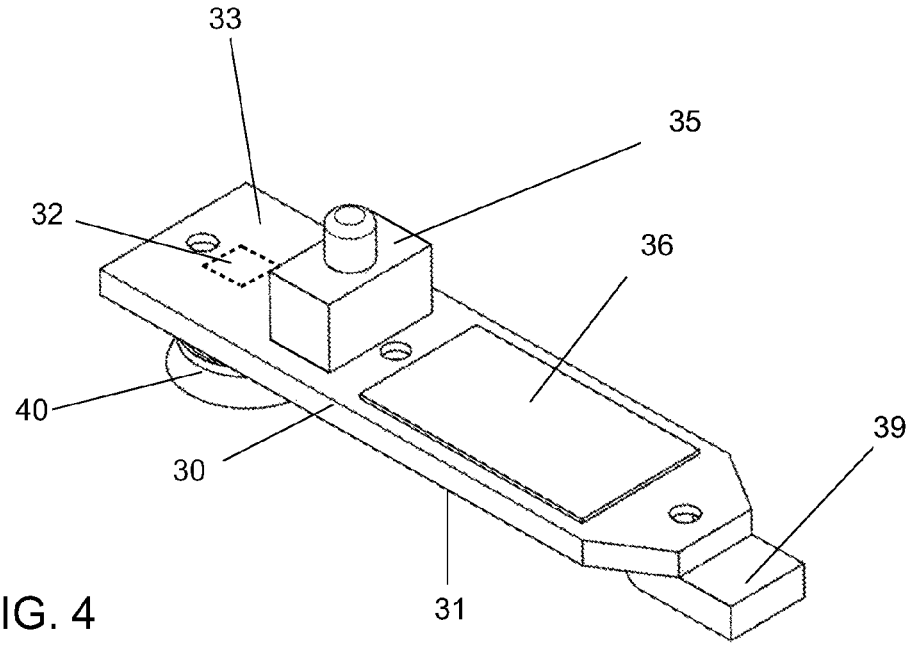
FIG. 4 is a top perspective view of an UV LED lighting assembly for the UV LED curing apparatus according to one embodiment of the present invention.
Figure 5:
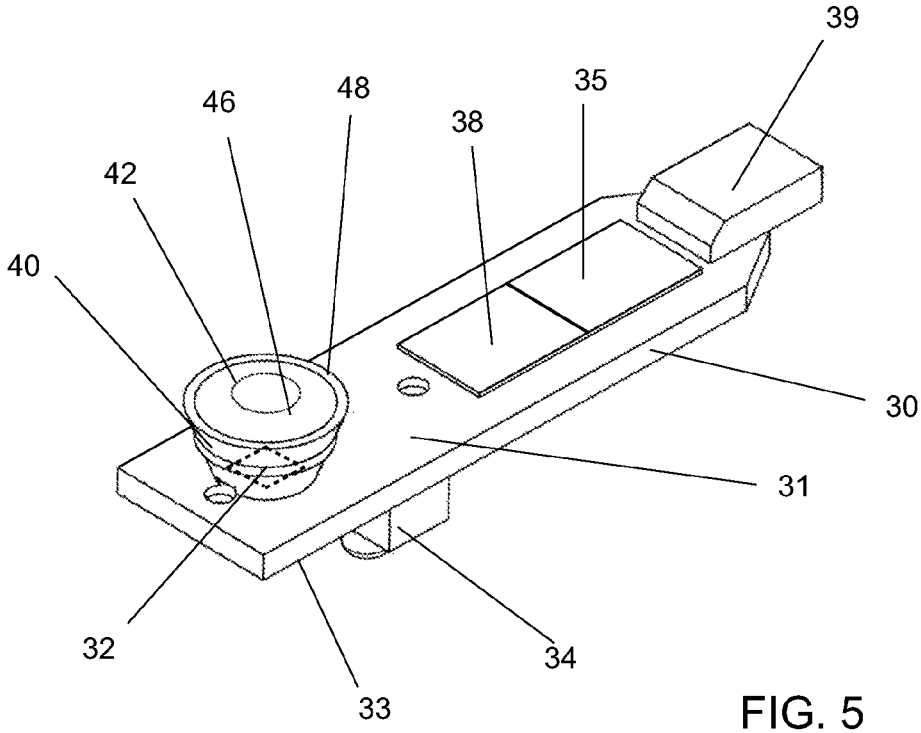
FIG. 5 is a bottom perspective view of an UV LED lighting assembly for the UV LED curing apparatus in FIG. 4.

FIGS. 4 and 5 show an explanatory embodiment of the abovementioned UV LED lighting assembly of the UV LED curing apparatus 10 of the present invention. As mentioned previously, the UV LED lighting assembly of the UV LED curing apparatus 10 comprises a substrate 30, an UV LED light source 32, a switch 34, a power supply 36 and an optical element 40; wherein the power supply 36 may be attached to the substrate 30 and at a distance away from the UV LED light source 32 on the substrate 30. The power supply 36 may further include an input terminal 39 on the first surface 31 of the substrate 30 and electrically connected to the UV LED light source 32. In a preferred embodiment, the input terminal 39 may include a universal-serial-bus (USB) connector. The substrate 30 may too be further integrated with a timer means 35 and a current regulator 38 electrically connected to the switch 34 such that the control of the lighting may be enhanced in terms of exposure time and/or power output. In one embodiment, both the timer means 35 and the current regulator 38 may be disposed on a first surface 31 of the substrate 30; in another embodiment, they may be disposed on a second surface 33 of the substrate 30. According to a preferred embodiment, the switch 34 may be preferably provided on the second surface 33 of the substrate 30 opposite to the first surface 31. In another embodiment, the timer means 35 and the current regulator 38 may be preferably provided on the first surface 31 of the substrate 30 and away from the UV LED light source 32 affixed thereon, such that the heat effect may be reduced due to such arrangement of components on the substrate.

As the switch 34 of the UV LED curing apparatus 10 of present invention may be electrically connected to the timer means 35 and the current regulator 38 on the substrate 30, the switch 34 may control an on-off state of the UV LED light source 32 upon an activation by for example, external user input. In a preferred embodiment, the switch 34 may be preferably attached to the second surface 33 of the substrate 30 and may be a tag switch capable of sending an input signal to the timer means 35 having a predefined interval of time with reference to the input signal preset therein. Referring to FIGS. 1 and 2 again, the switch 34 may further include a button 37 attached thereon, allowing easy access to and triggering of the switch by user. Furthermore, the substrate 30 may further include an indicator I electrically connected to the switch 34 and the power supply 36 to indicate the on-off state of the UV LED light source 32.

Figure 6:
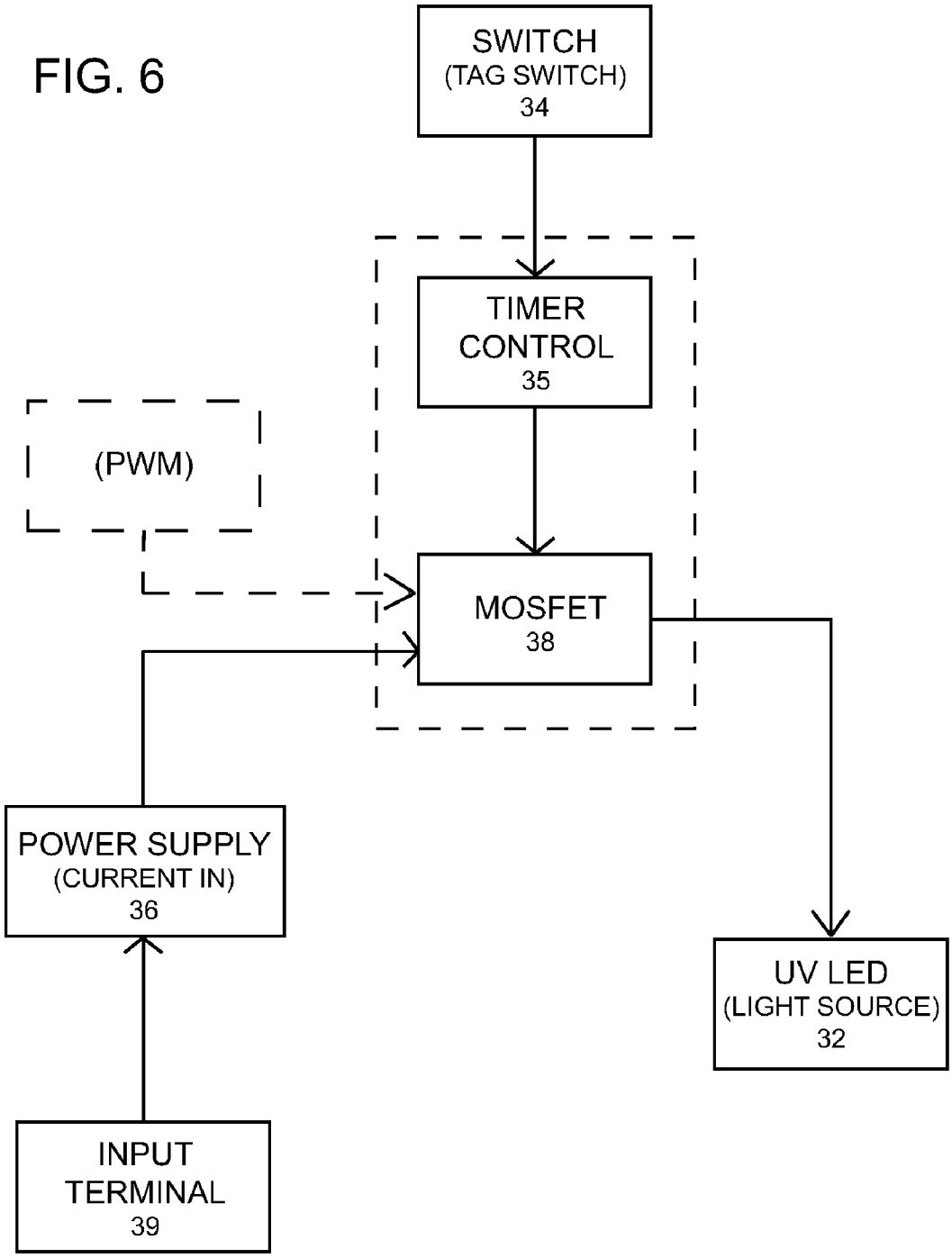
FIG. 6 shows an illustrative circuit diagram integrated on the UV LED lighting assembly for the UV LED curing apparatus according to one embodiment of the present invention.

The UV LED curing apparatus 10 is capable of providing improved illumination of UV light in terms of dedicated spectrum or wavelength of the UV LED light source 32 and focused lighting shaped and confined by the optical element 40 provided therein. In addition, the UV LED curing apparatus 10 of the present invention is also capable of providing an improved timer control in terms of exposure time and power output of the UV light. FIG. 6 shows a circuit block diagram of the UV LED curing apparatus 10 according to one embodiment of the present invention. As shown in FIG. 6, the output and/or on-off state of the UV LED light source 32 may be electrically controlled by the timer means 35 and the current regulator 38 connected to the power supply 36; wherein the timer control 35 may be triggered in response to a signal input from the switch 34 electrically connected thereto. Furthermore, the current regulator 38 may regulate current from the input terminal 39 of the power supply 36 to the UV LED light source 32 with reference to a predefined interval of time signaled from the timer means 35 and triggered by the switch 34 to control the on-off state of the UV LED light source 32. In other words, during an operation, a user may press the switch 34 to activate the timer means 35 having a certain period of time preset or predefined therein by for example a clock circuitry, and onto which the signal may be received by the current regulator 38 capable of regulating the current supplied from the power supply 36 to control the on-off state the UV LED light source 32. In a specific example, the certain period of time predefined in the timer means 35 may be between 5 and 40 seconds and preferably to be 30 seconds. According to an explanatory embodiment, the switch 34 sends a triggering signal to the timer means 35 to start the count-down of the preset period of time of the timer means 35, such as 30 seconds, and an on-state signal is sent to the current regulator 38 to turn on the UV LED light source 32; as the preset period of time lapses, an off-state signal is then sent from the timer means 35 to the current regulator 38 such that the UV LED light source 32 is turned off automatically.

In a preferred embodiment of the present invention, the current regulator 38 may be a metal-oxide-semiconductor field-effect (MOSFET) transistor capable of regulating current from the input terminal 39, preferably an USB connector, of the power supply 36 to the UV LED light source 32 with reference to a predefined interval of time signaled from the timer means 35 and triggered by the switch 34 to control the on-off state of the UV LED light source 32. As previously mentioned, it may be preferable that the predefined interval of time of the current regulator 38 signaled from the timer means 35 and triggered by the switch 34 may be between 5 and 40 seconds; and in a specific embodiment, it is approximately 30 seconds. In other words, the abovementioned time gap between the on-state signal and the off-state signal sent by the timer means 35 to the current regulator 38 may be any period of time between 5 and 40 seconds, preferably to be 30 seconds. In addition, a pulse-width modulation/PWM may be further provided and electrically connected to the power supply 36 to increment the amount of electrical power between fully on and fully off. In other words, a PWM may be further provided for tuning the output of UV LED light source 32 and allowing the UV curing apparatus 10 of the present invention to be of an adjustable UV lighting.

Figure 7:
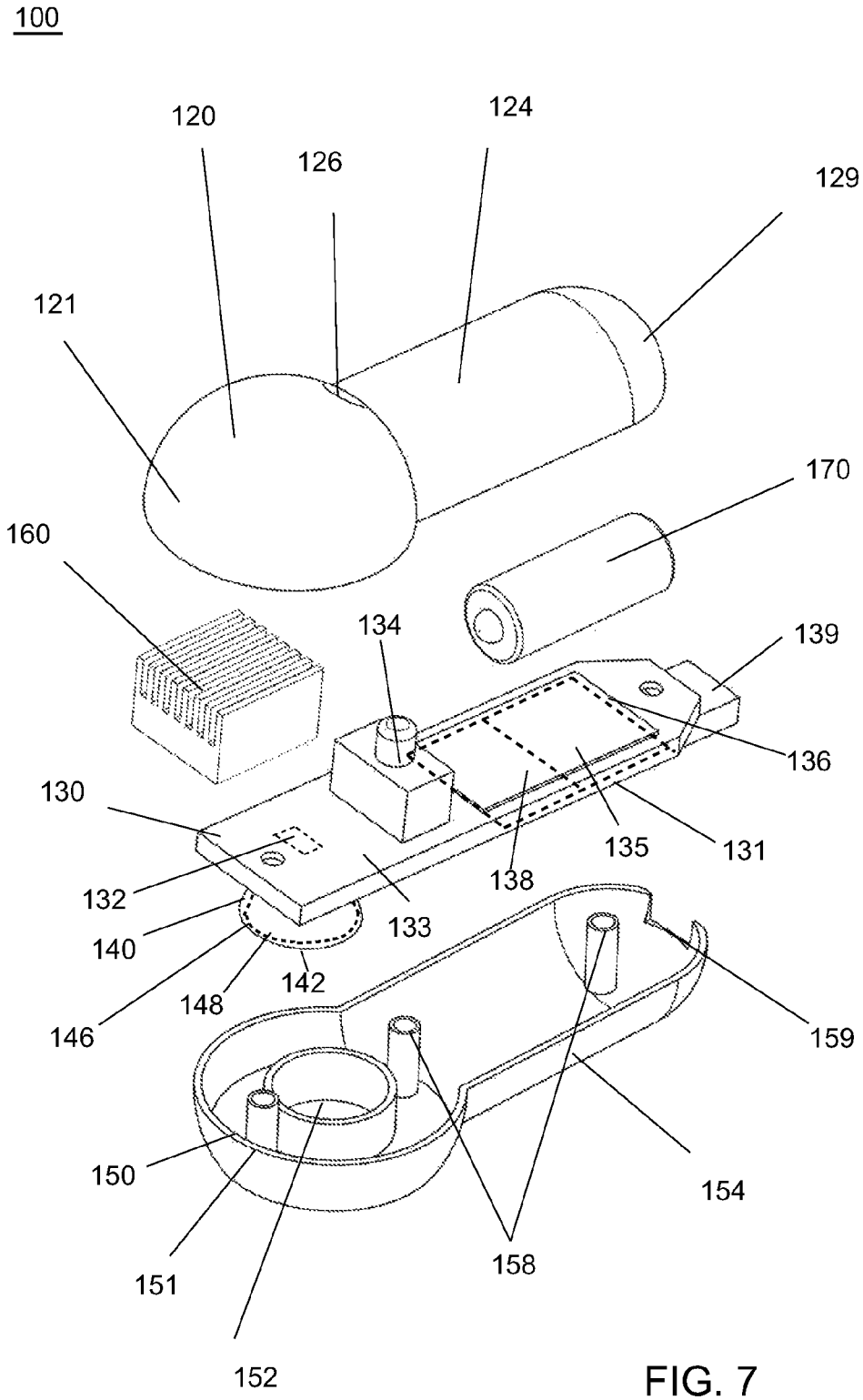
FIG. 7 shows an exploded view of a handheld UV LED curing apparatus according to another embodiment of the present invention.

FIG. 7 shows another explanatory embodiment of the present invention. The present invention may be provided in various forms including a standalone or desktop lamp and a handheld device, both may be portable. A handheld UV LED curing apparatus 100 may too comprise a housing and an UV LED lighting assembly enclosed within the housing. The housing further may comprise a top shell 120 including a handle portion 124 formed thereon and a bottom cover 150 attached to the top shell 120 and a light aperture 152 formed on the bottom cover 150. The handle portion 124 may be provided near a back end 129 of the top shell 120 of the housing away from the front end 121 thereof to enhance the portability and handling of the apparatus. The UV LED lighting assembly may further comprise a substrate 130, an UV LED light source 132, an optical element 140, a power supply 138 and a switch 134. As shown in the figure, the substrate 130 may be secured within the housing and enclosed by the top shell 120 and the bottom cover 150 via the fixation means 158. In addition, the substrate 130 may too comprise a timer means 135 and a current regulator 138 integrated on the substrate 130. In a preferred embodiment, the timer means 135 and the current regulator 138 may be on a first surface 131 of the substrate 130 and preferably at a distance away from the UV LED light source 132; and in another embodiment, the timer means 135 and the current regulator 138 may be provided on a second surface 133 of the substrate 130 opposite to the first surface 131 thereof and preferably at distance away from the UV LED light source 132.

The UV LED light assembly of the handheld UV LED curing apparatus 100 also comprises an UV LED light source 132 (shown by dashed line in FIG. 7) attached to the first surface 131 of the substrate 130. The UV LED light source 132 may comprise at least one UV LED emitter having a short wavelength and a light emitting side L' directed to the light aperture 152 of the bottom cover 150 of the housing. As mentioned previously, the UV LED or LED emitter of the UV LED light source 132 may be a lamp type LED, SMD type LED or can type LED; preferred examples of UV LEDs include Nichia UV LED model NSPU510CS, NCSU033A, NSHU591B. It can be understood that other UV LEDs capable of curing an UV hardening gel such as acrylic gel may be used. An UV hardening gel may transform from a liquid-like state to a solid state while being exposed to UV rays; in particular, UV LED hardening gel may undergo such phase change of solidification within 30 seconds of time subject to the UV LED light. To enhance the cooling of the UV LED light source 132 attached on the first surface 131 of the substrate 130, in a preferred embodiment, a heat sink 160 may be further attached to the second surface 133 thereof and preferably disposed beneath the UV LED 132 thereof by means of for example adhesives. Preferably, the substrate 130 may be a MCPCB to facilitate the heat conduction from the UV LED light source 132 to the heat sink 160 and/or the apparatus as a whole.

The optical element 140 of the UV LED light assembly of the handheld UV LED curing apparatus 100 of the present invention may be attached to the substrate 130 and aligned with the light aperture 152 of the bottom cover 150 of the housing. In other words, the optical element 140 may be preferably positioned adjacent to the UV LED light source 132 on the light emitting side L' thereof and aligned with the UV LED light source 132 and the light aperture 152 to provide down light toward an external of the housing via the light aperture 152 thereon and to confine light escaping outside of the optical element 140 and/or the housing. It can also be understood that other directions of illumination are also possible depending upon the direction and/or arrangement of the light aperture 152 on the housing. In a preferred embodiment, the optical element 140 may further comprise a collimator 146 (shown by dashed line in FIG. 7) having a light output surface 142 aligned with the light aperture 152 of the housing and may too comprise a reflector 148 (shown by dashed line in FIG. 7) circumferencing the UV LED light source 132 to direct light emitted from the light emitting side L' of the UV LED light source 132 toward an external of the light aperture 152 of bottom cover 150 of the housing of the UV curing apparatus 100 of the present invention. Furthermore, in order to provide a focused illumination onto an UV hardening gel applied to the nails of human fingers or toes and/or those of animal pets, in one embodiment, the light aperture 152 of the housing, preferably on the bottom cover 150 thereof, may be of a diameter substantially greater than 5 mm; and more particularly, the diameter may be approximately 10 mm for a proper application to average human hands and feet.

The UV LED lighting assembly of the handheld UV LED light apparatus 100 may further comprise a power supply 136 attached to a second surface 133 of the substrate 130 opposite to the first surface 131 thereof and at a distance away from the UV LED light source 132 on the substrate 130 within the housing. The power supply 136 may further include an input terminal 139 on the first surface 131 and electrically connected to the UV LED light source 132. In a preferred embodiment, the input terminal 139 may include a universal-serial-bus (USB) connector. As shown in FIG. 7 again, in one embodiment, the power supply 136 of the handheld UV LED light apparatus 100 may further include a rechargeable battery 170 adjacent to the input terminal 139, preferably away from the UV LED light source 132 on the substrate and within the housing, such that the portability of the UV LED curing apparatus 100 of the present invention may be enhanced.

Likewise, the substrate 130 of the UV LED curing apparatus 100 may too be further integrated with a timer means 135 and a current regulator 138, preferably on the first surface 131 of the substrate 130, electrically connected to a switch 134 attached to the second surface 133 thereof, such that the control of the lighting of the UV LED light source 132 may be enhanced in terms of exposure time and/or power output and such that the heat dissipation of these components on the substrate 130 may be well handled on both surfaces of the substrate 130. The abovementioned input terminal 139 of the power supply 136 may too be connected to the UV LED light source 132 via the current regulator 138 on the substrate 130. Likewise, in one embodiment, the rechargeable battery 170 of the power supply 136 may too be electrically connected to the input terminal 139 and the current regulator 138. In addition, the switch 134 may be electrically connected to the timer means 135 and the current regulator 138 on the substrate 130 to control an on-off state of the UV LED light source 132 upon activation by for example, user input. In a preferred embodiment, the switch 134 may be preferably extending to an opening 126 on the top shell 120 of the housing allowing easy access by the user; additionally, the switch 134 may be a tag switch capable of sending an input signal to the timer means 135 having a certain interval of time preset therein as for example clock circuitry and the interval of time may preferably be 30 seconds. In another preferred embodiment, a PWM may too be further provided and electrically connected to the power supply 136 to increment the amount of electrical power between fully on and fully off. In other words, a PWM may be further provided for enhancing the control of the on-off state of UV LED light source 132 at the peak of the pulse received. The circuitry recited herein may too be referred to FIG. 6 and the previously mentioned on-state signal and off-state signal sent from the timer means 135 to the current regulator 138.

During an explanatory operation of the UV LED curing apparatus 100 of the present invention, user may trigger the switch 134 in order to obtain desired UV light from the UV LED light source 132 of the UV LED lighting assembly, upon which the current regulator 138 may be activated by the switch 134 to regulate current supplied from the input terminal 139 and/or the rechargeable battery 170 of the power supply 136 to the UV LED light source 132 with reference to a predefined interval of time signaled from the timer means 135 connected thereto and also triggered by the switch 134 to control the on-off state of the UV LED light source 132. For example, when the exposure time is preset to be 30 seconds, depending upon the switch 134 or tag switch of the apparatus of the present invention, the timer means 135 may respond accordingly as a start to send an on-state signal to the current regulator 138 to turn on the UV LED light source 132 and as the predefined period of time in the timer means is lapsed, an off-state signal is then send to the current regulator 138 from the timer means 135 again to turn off the UV LED light source 132. In other words, upon the ending of such period of time, for example 30 seconds, the current regulator 138 may shut the current from the power supply to turn off the UV LED light source 132 automatically. The previously mentioned PWM may be further provided to enhance the control of the on-off state of the UV LED light source 132 as current or power may be transmitted from the power supply 136 to the current regulator 138 at a desired peak value.

The optical element 140 may direct and confine UV light emitted from the UV LED light source 132 toward the light aperture 152 of bottom cover 150 of the housing. The UV LED light source comprising at least one UV LED emitter may then cure an UV hardening gel by solidifying said UV hardening gel from a liquid state to a solid state applied onto the nails of fingers or toes. It can be understood that the period of time other than the abovementioned 30 seconds are also possible; for example, an optimal exposure period of time of UV light on the UV hardening gel may be preferably preset to be between 5 and 40 seconds. As the UV curing apparatus of the present invention is capable of providing an improved illumination with timer control, it can be understood that the utilization of the UV curing apparatus with or without any UV hardening gel in the application of the nails of human hands and feet shall too be within the scope of the present invention. Examples of UV hardening gel, such as an acrylic type gel, including urethane-methacrylate and epoxy-methacrylate from manufacturers such as Keystone®, BIO®, CNC®, COSMEX™. The introduction of an UV LED kit including the UV curing apparatus of the present invention and any UV hardening gel shall too be considered to be within the scope of the present invention. The UV hardening gel may be cured or solidified effectively and safely from a liquid-like state to a solid state under the UV light provided by the UV curing apparatus of the present invention.

While the present invention is disclosed in reference to the preferred embodiments or examples above, it is to be understood that these embodiments or examples are intended for illustrative purposes, which shall not be treated as limitations to the present invention. It is contemplated that modifications and combinations will readily occur to those skilled in the art, which modifications and combinations will be within the spirit of the invention and the scope of the following claims.

What is claimed is:

1. An UV LED curing apparatus, comprising:

a housing comprising a top shell attached to a bottom cover and a light aperture formed on one end thereof;

a substrate comprising a timer means and a current regulator, secured within the housing and enclosed by the top shell and the bottom cover of the housing;

an UV LED light source affixed to the substrate and having a light emitting side facing toward the light aperture formed on the one end of the housing;

an optical element comprising a collimator having a light output surface aligned with the light aperture of the housing, secured to the substrate and positioned adjacent to the UV LED light source;

a power supply comprising an input terminal electrically connected to the UV LED light source via the current regulator on the substrate, attached to the substrate and at a distance away from the UV LED light source;

a switch electrically connected to both the timer means and the current regulator on the substrate; and whereby the current regulator regulates current from the input terminal of the power supply to the UV LED light source with reference to a predefined interval of time signaled from the timer means and triggered by the switch to control an on-off state of the UV LED light source.

2. The UV LED curing apparatus as claimed in claim 1, wherein the timer means and the current regulator are integrated on a first surface of the substrate and the switch is attached to a second surface of the substrate opposite to the first surface thereof.

3. The UV LED curing apparatus as claimed in claim 1, wherein the UV LED light source comprises at least one UV LED having a short wavelength between 360 nm and 410 nm.

4. The UV LED curing apparatus as claimed in claim 1, wherein the light emitting side of the UV LED light source is substantially perpendicular to the substrate.

5. The UV LED curing apparatus as claimed in claim 1, wherein the collimator of the optical element is a plano-convex lens having a convex light output surface.

6. The UV LED curing apparatus as claimed in claim 1, wherein the optical element further comprises a reflector aligned to the collimator and having a reflective surface circumferencing the UV LED light source to reflect and confine light emitted therefrom toward an external of the light aperture of the housing.

7. The UV LED curing apparatus as claimed in claim 6, wherein the reflective surface of the reflector of the optical element is formed of any one of the following metal alloys: silver, nickel, cobalt, aluminum and combinations thereof.

8. The UV LED curing apparatus as claimed in claim 1, wherein the substrate is a MCPCB.

9. The UV LED curing apparatus as claimed in claim 1, wherein the substrate further comprises a heat sink attached to the substrate and disposed beneath the UV LED light source attached thereon.

10. The UV LED curing apparatus as claimed in claim 1, wherein the power supply further comprises a rechargeable battery electrically connected to the input terminal and the current regulator.

11. The UV LED curing apparatus as claimed in claim 1, wherein the current regulator is a MOSFET.

12. The UV LED curing apparatus as claimed in claim 1, wherein the switch is a tag switch.

13. The UV LED curing apparatus as claimed in claim 1, wherein the predefined interval of time signaled from the timer means to the current regulator is between 5 and 40 seconds.

14. The UV LED curing apparatus as claimed in claim 1, wherein the input terminal of the power supply comprises an USB connector.

15. The UV LED curing apparatus as claimed in claim 1, wherein the substrate further comprises a PWM electrically connected to the timer means and the current regulator.

16. A handheld UV LED curing apparatus, comprising:

a housing comprising a top shell including a handle portion formed thereon, a bottom cover attached to the top shell and a light aperture formed on the bottom cover;

a substrate secured within the housing and enclosed by the top shell and the bottom cover of the housing, having a first surface and a second surface, integrated with a timer means and a current regulator thereon;

an UV LED light source attached to the first surface of the substrate, comprising at least one UV LED emitter having a short wavelength and a light emitting side facing toward the light aperture of the bottom cover of the housing;

an optical element secured onto the substrate and positioned adjacent to the UV LED light source, comprising a collimator having a light output surface aligned with the light aperture of the housing and a reflector circumferencing the UV LED light source;

a power supply attached to the substrate and at a distance away from the UV LED light source on the substrate within the housing, comprising an input terminal electrically connected to the UV LED light source via the current regulator on the substrate;

a switch attached to the second surface of the substrate and electrically connected to both the timer means and the current regulator on the substrate;

whereby the current regulator regulates current from the input terminal of the power supply to the UV LED light source with reference to a predefined interval of time signaled from the timer means and triggered by the switch to control an on-off state of the UV LED light source automatically; and whereby the optical element directs and confines UV light emitted from the UV LED light source toward the light aperture of the housing.

17. The handheld UV LED curing apparatus as claimed in claim 16, wherein the short wavelength of the UV LED emitter of the UV LED light source is between 360 nm and 410 nm.

18. The handheld UV LED curing apparatus as claimed in claim 16, wherein the collimator of the optical element is a plano-convex lens having a convex light output surface; and the reflective surface of the reflector of the optical element is formed of any one of the following metal alloys: silver, nickel, cobalt, aluminum and combinations thereof.

19. The handheld UV LED curing apparatus as claimed in claim 16, wherein the predefined interval of time signaled from the timer means and triggered by the switch is between 5 and 40 seconds.

20. The handheld UV LED curing apparatus as claimed in claim 16, wherein the power supply further comprises a rechargeable battery electrically connected to the input terminal and the current regulator.

* * * * *